US005415303A

United States Patent [19]

Hodges et al.

[11] Patent Number: 5,415,303

[45] Date of Patent: May 16, 1995

[54] RAILCAR CUSHION UNIT

[75] Inventors: Richard N. Hodges; Harry B. Kalina, both of Arlington, Tex.

[73] Assignee: F M Industries, Inc., Fort Worth, Tex.

[21] Appl. No.: 113,271

[22] Filed: Aug. 27, 1993

[51] Int. Cl.[6] ..... B61G 9/08

[52] U.S. Cl. ..... 213/43; 188/269; 188/322.13; 137/542; 137/543.13; 137/536

[58] Field of Search ..... 213/7, 8, 10, 40 R, 213/41, 43, 44, 45, 46 R, 50; 188/269, 287, 312, 315, 316, 322.13, 322.22; 267/64.11; 137/542, 543.13, 536

[56] References Cited

U.S. PATENT DOCUMENTS

| | | | |
|---|---|---|---|
| 3,516,520 | 6/1970 | Agren et al. | 264/64.11 X |
| 3,568,855 | 3/1971 | Seay et al. . | |
| 3,589,527 | 6/1971 | Seay et al. . | |
| 3,589,528 | 6/1971 | Stephenson . | |
| 3,598,249 | 8/1971 | Vickerman | 213/43 X |
| 3,647,088 | 3/1972 | Seay et al. . | |
| 3,752,329 | 8/1973 | Seay et al. . | |
| 3,791,534 | 2/1974 | Stephenson . | |
| 3,854,596 | 12/1974 | Stephenson et al. . | |
| 3,864,922 | 2/1975 | Dial et al. . | |
| 4,026,418 | 5/1977 | Hawthorne . | |
| 4,043,545 | 8/1977 | Dial et al. . | |
| 4,113,113 | 9/1978 | Reinhardt et al. . | |
| 5,025,938 | 6/1991 | Bomgardner et al. . | |

*Primary Examiner*—Mark T. Le
*Assistant Examiner*—S. Joseph Morano
*Attorney, Agent, or Firm*—James E. Bradley; Grady K. Bergen

[57] ABSTRACT

A railway car cushioning device is provided for minimizing slack between railway cars. The cushioning device is provided with a piston and piston rod disposed within the cylinder. The cylinder is filled with an oil and gas mixture. A housing surrounds the cylinder providing a fluid recovery reservoir defined by the space between the outer wall of the cylinder and the housing. At one end of the cylinder is a bulkhead and at the other end is a cylinder head. The piston rod extends through a hole formed in the cylinder head and is joined to the sill of a railcar. A coupler is joined to the cushioning device for coupling to another railway car. A series of pressure relief valves are provided and engaged with egress ports formed in the cylinder wall between the bulk head and the piston when the piston is in an extended position. The pressure relief valves are constructed so that fluid may flow in only one direction, from the interior of the cylinder to the fluid reservoir. The pressure relief valves open only in response to a given fluid pressure within the cylinder. A restoration valve allows fluid to escape from the cylinder when the piston is restored to its initial position, and a bleed valve is provided for exhausting gas from the cylinder when the cushioning device is at rest.

20 Claims, 3 Drawing Sheets

RAILCAR CUSHION UNIT

BACKGROUND OF THE INVENTION

1. Field of the Invention

This invention relates to a railcar cushioning device, and in particular to a means for creating a cushioning device which is responsive to a preselected force.

2. Description of the Prior Art

Railcars experience a great deal of shock during coupling operations and other train action which can damage cargo on the railcars and the railcars themselves. To absorb the high forces experienced by railcars during these operations, cushioning devices have been employed between the frame of the railcar and its coupler.

The shock experienced by railcars results from both buff and draft forces applied to the coupler of the railcar. The term "buff" is used to describe the movement experienced by a coupler when it is moved towards its associated railcar. These buff forces are usually experienced during coupling operations between the railcars. "Draft" describes the outward movement of the coupler away from its associated railcar in response to pulling forces acting on the coupler.

These cushioning devices are usually hydraulic piston and cylinder arrangements which absorb both buff and draft forces. The cylinders are filled with a hydraulic fluid which is forced through ports in the cylinder wall in response to the impact force applied to the piston. Characteristic of these cushioning devices, however, is the low level of impedance they provide in response to very low buff and draft forces. This response to very low buff and draft forces creates the undesirable effect of "slack" or "slop" between the railcars.

There is a need therefore for a cushioning device for a railcar that operates at a very high impedance when subjected to low level forces to thereby reduce the effect of slack between the railcars while still providing an effective cushion for absorbing high levels of shock between the railcars.

SUMMARY OF THE INVENTION

It is an object of this invention to provide a cushioning device for absorbing shock between railcars during both draft and buff movement while providing a high level of impedance when subjected to low levels of force to thereby minimize slack between the railcars.

In order to provide such a cushioning device, a cylinder containing a mixed gas and liquid and having a cylinder wall is located within a fluid recovery reservoir or housing. A bulkhead is located at one end of the cylinder and a cylinder head at the other end of the cylinder. A hole is located in the cylinder head for receiving a piston rod which extends through the hole.

A piston is mounted or coupled to the piston rod and is disposed within the cylinder. The piston and piston rod move from an extended position to a contracted position in response to buff forces. The piston rod is coupled at the opposite end to the frame or sill of a railcar. Coupling means are attached on the rod and the bulkhead opposite the rod for connecting the cushioning device between two railcars.

A plurality of egress ports are located in the cylinder wall between the piston and the bulkhead when the piston is in the extended position. The egress ports are spaced at various distances from the bulkhead. At least some of the ports are provided with pressure relief valves which allow fluid to flow from the interior of the cylinder to the fluid reservoir in response to a selected fluid pressure differential. The fluid pressure differential is created by buff and draft forces applied to the cushioning device during coupling and train action.

Each pressure relief valve has a body with a longitudinal axis. The body of the valve couples to the egress port. A valve piston is slidingly mounted within the body and has an axial flow passage. A valve seat is joined to the body of the valve. The valve seat has a frusto-conical recess for receiving a frusto-conical shaped head on the valve piston. The head of the valve piston sealingly engages the valve seat for preventing fluid flow through the pressure relief valve.

A plurality of valve ports are located in the head of the pressure relief valve piston and join the axial flow passage. The valve ports are at acute angles in relation to the longitudinal axis of the body of the valve. A coil spring encircles the valve piston and provides a resilient biasing means for urging the head of the valve piston into engagement with the valve seat.

A means for bleeding gas is provided for bleeding off nitrogen gas from the cylinder when the cushioning device is at rest. The reduction in the amount of gas in the cylinder also increases the impedance of the cushioning device to aid in minimizing slack between the railway cars.

A restoration valve is also provided which allows fluid to escape from the cylinder when the piston is moved by a restoring force to the extended position.

DETAILED DESCRIPTION OF THE INVENTION

Figure 1:
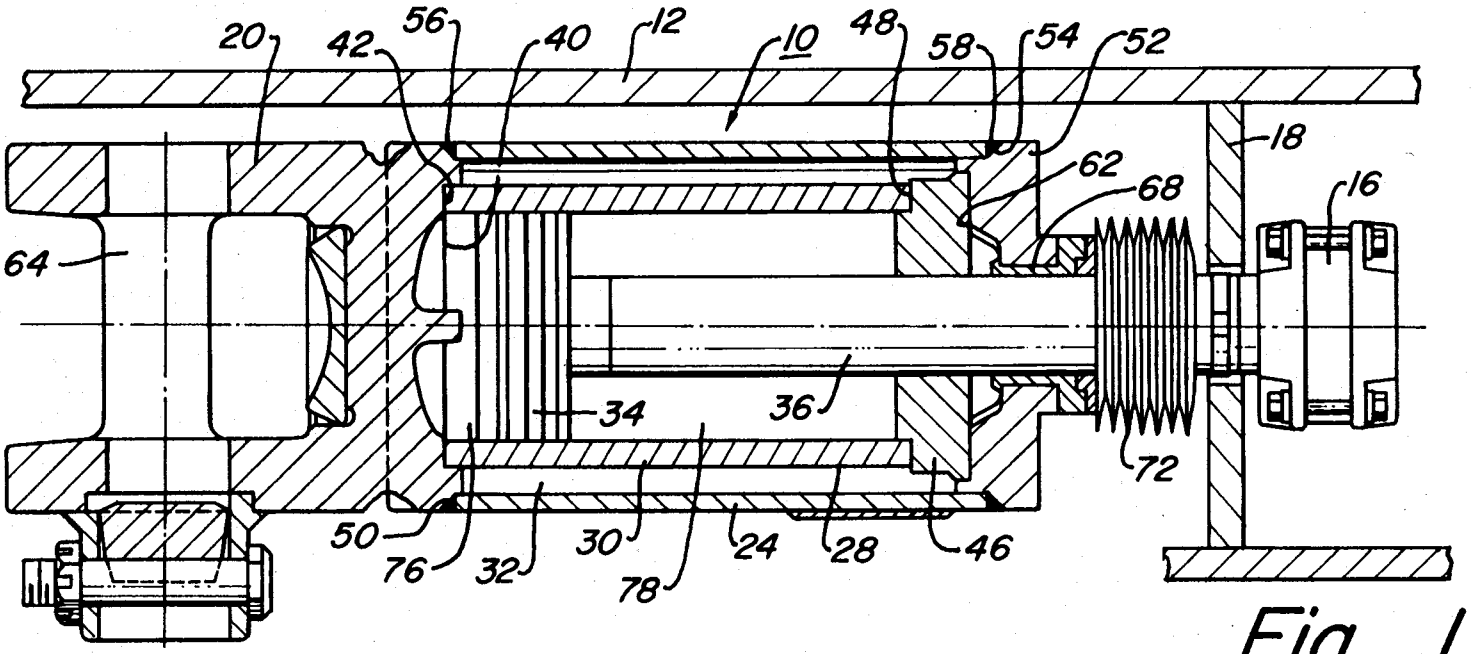
FIG. 1 is a sectional, side elevational view of the cushioning device constructed in accordance with the invention.

Referring to FIG. 1, a cushioning device 10 is mounted in the front sill 12 of a railway car. A piston rod retainer 16 is positioned within a support housing structure 18 of the sill 12. The cushioning device 10 comprises a body 20 with a cylinder housing 24. A cylinder 28 having a cylinder wall 30 is located within the housing 24 and is spaced radially inward from the housing 24 to define a fluid recovery reservoir 32 located between the interior of the housing 24 and the exterior of the cylinder wall 30. The cylinder 28 has a substantially circular cross section and is filled with a mixture of oil and nitrogen gas.

A piston 34 is located within the cylinder 28 and is attached to one end of a piston rod 36, the other end of the piston rod 36 being coupled to the piston rod retainer 16. A bulkhead 40 is located at the buff end of the cylinder 28. The buff end of the cylinder 28 is to the left as seen in FIG. 1. Likewise, the draft end is to the right, as shown in FIG. 1. The buff end of the cylinder 28 is mounted in a bulkhead cylinder seat 42 formed in the bulkhead 40.

At the draft end of the cylinder 28 is a cylinder head 46. The cylinder 28 is mounted to the cylinder head 46 at the cylinder seat 48 formed in the cylinder head 46.

The housing 24 is mounted at one end to the body 20 at seat 50 formed in the body 20. The other end of the housing 24 is mounted to an outer cylinder head 52 at cylinder seat 54. The housing 24 is joined to the body 20 and outer cylinder head 52 by welds 56, 58.

The piston rod 36 extends through concentric holes provided in cylinder heads 46, 52. The inner cylinder head 46 is seated against the outer cylinder head 52 in inner cylinder head seat 62. A coupler 64 is located at one end of the cushioning device 10 for coupling to another railcar and is integrally formed with the body 20.

As shown in FIG. 1, the cylinder head 52 is provided with a sleeve bearing 68. The sleeve bearing 68 supports the piston rod 36 as the piston rod is slid through cylinder head 52 from the draft and buff positions. A dust cover 72 is attached at one end to the outer cylinder head 52 and at the other end to the piston rod 36.

The piston 34 is received within the cylinder 28 dividing the interior of the cylinder 28 into areas 76, 78. The area 76 is the area between the bulkhead 40 and the forward end of the piston 34 opposite the piston rod 36. The area 78 is the area between the cylinder head 46 and the rearward or draft side of the piston 34 which adjoins the piston rod 36.

Although not shown in FIG. 1, the cylinder wall 30 of the cylinder 28 is provided with several threaded ports. Each of the ports is provided with a different threaded valve. The ports extend through the cylinder wall 30 between the interior of the cylinder 28 and the fluid reservoir 32. As shown in the FIG. 2, a pressure relief valve 80 is shown mounted in an egress port 79 which extends through the cylinder wall 30. Similarly, a floating ball valve 82 is mounted in port 83 of the cylinder 28, a restoration valve 84 is mounted in port 85 and a check valve 86 is mounted in port 87.

Figure 3:
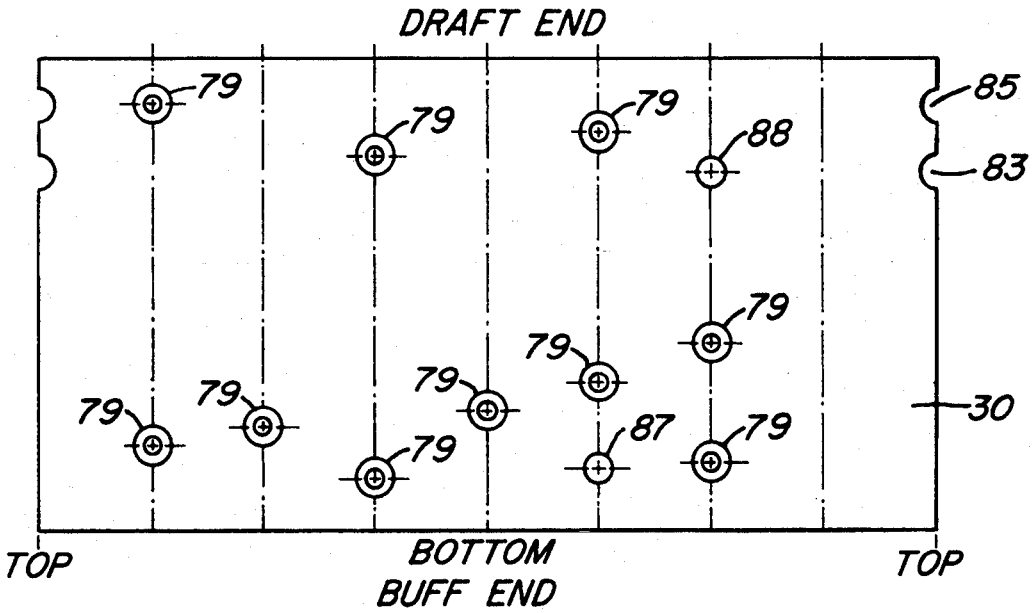
FIG. 3 is a plan view of the inner cylinder wall of the cushioning device of FIGS. 1 and 2, with the cylinder wall "layed flat".

FIG. 3 shows the cylinder wall 30 layed flat so that the location of the ports for the valves can be seen. It should be noted that the number of valves and ports in the cylinder wall 30 can be varied as well as their location depending on the design or specifications of the cushioning device 10.

In the apparatus depicted in FIG. 3, there is one port 85 for the restoration valve 84 located at the extreme draft end of the cylinder 28. The restoration valve 84 remains on the draft side of the piston 34 even when the piston 34 is in the fully extended, draft position. The restoration valve 84 is designed to meter out fluid in area 78 of the cylinder 28 at low pressures to allow the cushioning device 10 to restore or extend due to a restoring force. The restoring force could be a spring or other conventional means to restore the cushioning device 10 to a precompressed or extended position. The valve 84 closes when a significant draft or extension force, other than the restoring force, is applied to the device 10.

Located near the draft end of the cylinder 28 are two ports 83 and 88 for floating ball valves 82. The ports 83 and 88 are located slightly forward of the restoration valve port 85 towards the buff end of the cylinder 28 so that when the piston 34 is in the fully extended position the ports 83 and 88 are on the buff side of the piston 34. The port 83 is located at the top of the cylinder 28 when mounted in the sill 12 of the railway car. The port 88 is circumferentially spaced approximately 90 degrees apart from the port 83 on the cylinder wall 30.

The floating ball valve 82 mounted in the port 83 serves as a bleed valve and allows nitrogen gas to escape through the top of the cylinder 28 and into the reservoir 32 when the cushioning device 10 is at rest. The pressure within the cushioning device 10 is thus equalized so that the pressures within the cylinder 28 and the reservoir 32 are substantially the same when the cushioning device 10 is at rest. The reduction in the amount of gas within the cylinder 28 creates a higher impedance in the cushioning device 10. The more gas there is in the cylinder 28, the further the piston 34 must travel through the cylinder 28 to create a given pressure, thus increasing the amount of slack in the cushioning device 10. This is due to the high compressibility of the gas as compared to the oil.

The second floating ball valve 82 mounted in port 88 is located below the oil level within cylinder 28 with the axis of the valve being 90 degrees from the first floating ball valve 82 mounted in port 83. This valve 82 in port 88 allows oil to reenter the cylinder 28 as gas escapes from the cylinder 28 and displaces the oil within the reservoir 32.

Both floating ball valves 82 in ports 83 and 88, when located on the draft side of the piston 34, close when there is a sudden pressure increase in the cylinder 28 due to the compression of the fluid within the area 78 of the cylinder 28 when the piston 34 is moved in the draft direction.

Located near the extreme buff end of the cylinder 28 is the port 87 for the check valve 86. The check valve 86 allows fluid to flow into area 76 in the cylinder 28 when the piston 34 is restored to the draft or extended position.

Numerous pressure relief valves 80 are located in the egress ports 79, shown in FIG. 3, at various points along the length of the cylinder 28 between the bulkhead 40 and the forward end of the piston 34 when the piston is in the draft or fully extended position.

Figure 2:
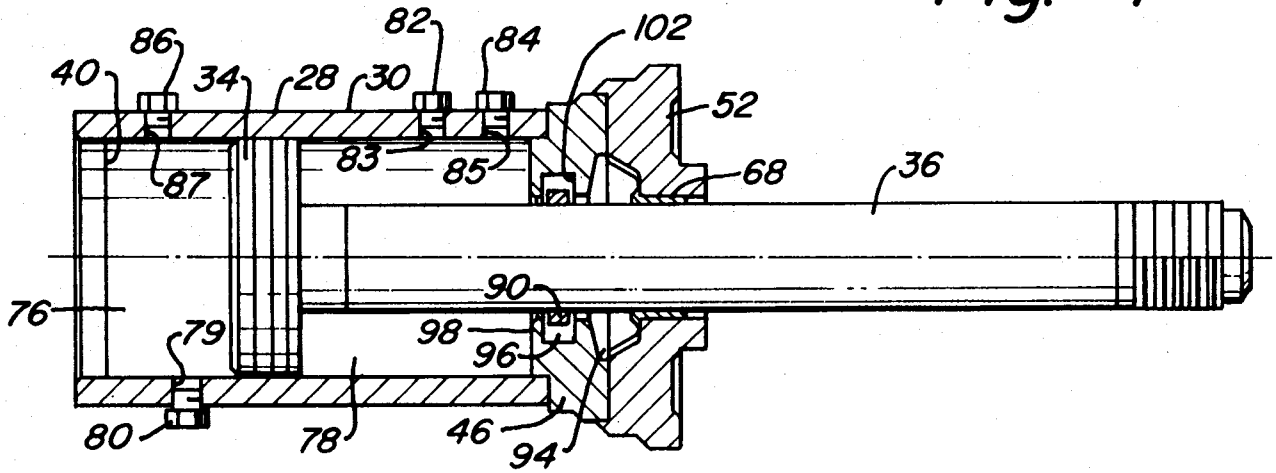
FIG. 2 is a sectional, side elevational view of the cylinder and cylinder head showing various valves engaged with the ports of the cylinder wall and constructed in accordance with the invention.

Although not depicted in FIG. 1, a slider or sleeve valve 90 is provided in the cushioning device 10 and shown in FIG. 2. Formed within the cylinder head 46, 52 is a buff flow chamber 94. The buff flow chamber 94 is in communication with a buff flow passage (not shown) which leads to the reservoir 32. The slider valve 90 and its operation are described in detail in U.S. Pat. No. 5,025,938 and those portions which are applicable to the operation of the slider valve 90 are hereby incorporated by reference.

Slider valve 90 is located in a slider valve sleeve chamber 96 formed in the cylinder head 46. The slider valve 90 is retained within the slider valve sleeve chamber 96 by a slider valve retainer lip 98. The retainer lip 98 is formed from discontinuous, circumferentially extending portions that allow fluid to flow from the valve chamber 96 into the interior area 78 of cylinder 28 when the slider valve 90 is seated against the retainer lip 98. A sealing surface 102 is provided opposite the retainer lip 98 for sealing engagement with the slider valve 90.

Figure 4:
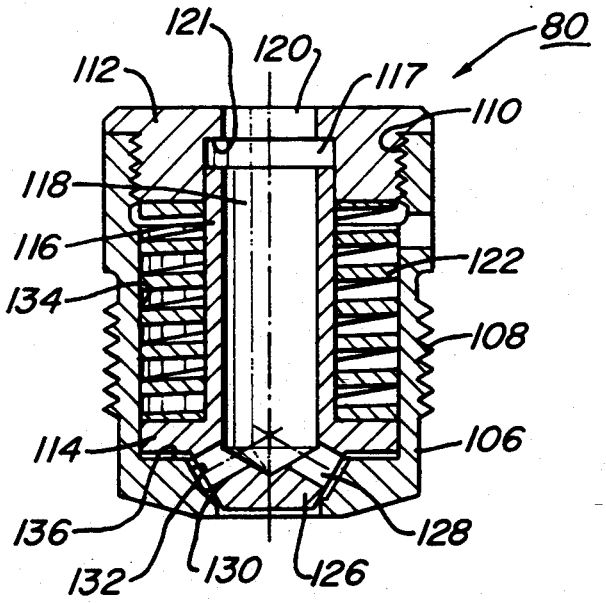
FIG. 4 is a sectional view of the pressure relief valve of FIG. 5 taken along the lines IV—IV.
Figure 5:
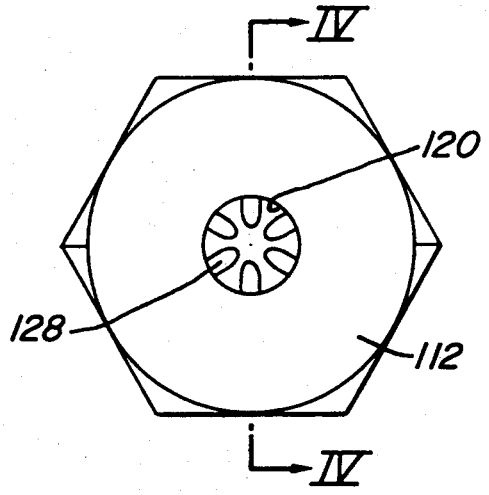
FIG. 5 is a top plan view of the pressure relief valve constructed in accordance with the invention.

Each of the pressure relief valves 80 are constructed as shown in FIGS. 4 and 5. Each pressure relief valve allows fluid to flow from the cylinder 28 to the reservoir 32 in one direction. The pressure relief valve 80 consists of a cylindrical body 106 having an exterior threaded portion 108 for engagement with the egress port 79 formed in the cylinder wall 30 of the cylinder 28 which has a corresponding threaded portion (not shown).

The body 106 is provided with an internal threaded portion 110 for coupling with a threaded cap 112. The body 106 has a cylindrical, hollow interior into which a valve piston 114 is positioned.

A generally cylindrical piston shaft 116 extends from and is integrally formed at one end to the valve piston 114. The opposite end of the piston shaft 116 is slidingly received within a cylindrical piston shaft recess 117 formed in the threaded cap 112.

An axial flow passage 118 extends through both the valve piston 114 and the piston shaft 116. The axial passage 118 is concentric with a circular port 120 formed in the cap 112 above the shaft recess 117. The shaft recess 117 and the port 120 are concentric with each other. The port 120 has a diameter which is smaller than the diameter of the recess 117, thereby defining an annular shoulder 121. A coiled valve spring 122 encircles the piston shaft 116. The valve spring 122 is outwardly biased between the bottom of threaded cap 112 and the piston 114.

A frusto-conical shaped head 126 is joined to the lower portion of the piston 114 and has a plurality of valve ports 128 which are formed at acute angles in relation to the longitudinal axis of the body 106. The head 126 engages a valve seat 130 formed in a frusto-conical recess 132 of the body 106. The edges of the piston 114 are sealingly engaged with the interior walls 134 of the body 106 providing a seal between the piston 114 and the body 106.

Referring to FIG. 4, the coiled spring 122 is outwardly biased, forcing the valve piston 114 away from the cap 112 so that the frusto-conical shaped head 126 is engaged with the valve seat 130. With the head 126 thus seated, fluid is prevented from escaping from the cylinder 28 through the pressure relief valve 80.

As the fluid pressure within the cylinder 28 increases, the force exerted on the head 126 from the fluid pressure overcomes the force exerted by the spring 122 on the valve piston 114. The head 126 of the piston 114 is thereby unseated from the valve seat 130 so that fluid from the cylinder 28 flows through the valve ports 128, into the axial passage 118 and to the reservoir 32. Movement of the piston 114 is limited as the end of the piston shaft 116 opposite the piston 114 contacts the shoulder 121 formed in the threaded cap 112.

When the fluid pressure within the cylinder 28 falls below the preselected pressure required to overcome the biasing force of the spring 122, the head 126 is forced into sealing engagement with the valve seat 130 of the body 106, cutting off the flow of fluid from the cylinder 28 to the reservoir 32. The pressure relief valve 80 acts as a check valve, permitting fluid to flow only from the cylinder 28 to the reservoir 32.

Figure 6:
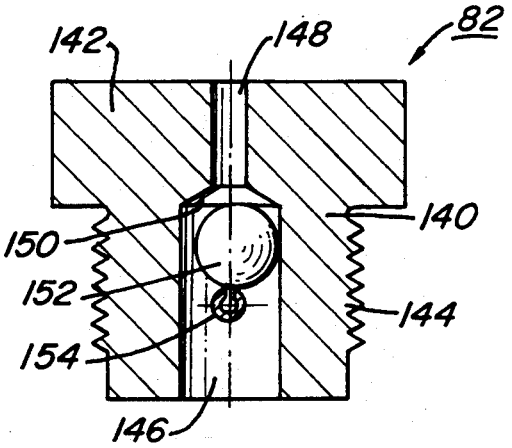
FIG. 6 is a sectional elevational view of the floating ball valve of FIG. 7 taken along the lines VI—VI.
Figure 7:
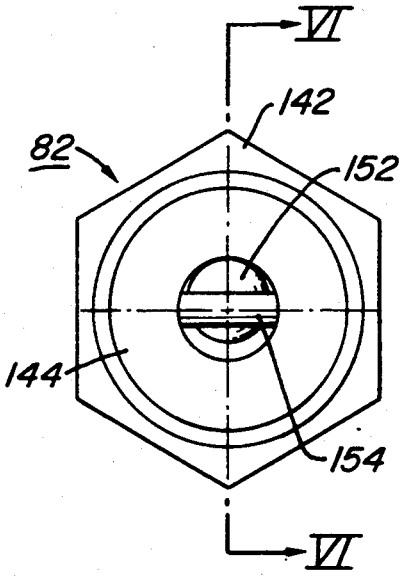
FIG. 7 is a bottom plan view of the floating ball valve constructed in accordance with the invention.

The floating ball valve 82, shown in FIGS. 6 and 7, consists of a valve body 140 having a longitudinal axis. The body 140 has an upper, hexagonal shaped head 142 which is integrally formed with a threaded lower portion 144 for engaging threaded ports 83 and 88.

A first, cylindrical axial passage 146 of the floating ball valve 82 extends through the lower threaded portion 144 and opens toward the interior of the cylinder 28. The first axial passage 146 is concentric with a second, cylindrical axial passage 148. The first passage 146 has a diameter that is greater than the diameter of the second passage. The axial passages 146, 148 are joined together by a concavity 150 which serves as a valve seat.

A steel ball 152 is located within the axial passage 146. The steel ball 152 has a diameter which is less than the diameter of the axial passage 146 so that the ball 152 moves freely within the axial passage 146. The steel ball 152 is retained in the axial passage 146 by a retaining pin 154 which extends perpendicularly through the axial passage 146.

With the ports 83, 88 located on the draft side of the piston 34, a sudden increase in the fluid pressure of area 78 of the cylinder 28 due to draft movement of the piston 34 causes the steel ball 152 of the floating ball valve 82 in both ports 83 and 88 to be forced against the concave valve seat 150 sealing off the axial passage 148 and thus preventing fluid flow through ports 83 and 88. Otherwise, the floating ball valves 82 remain open to allow the egress of gas and the ingress of oil.

Figure 8:
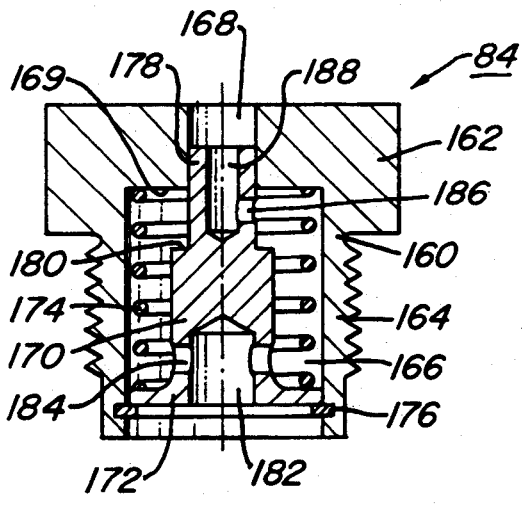
FIG. 8 is a sectional elevational view of the restoration valve of FIG. 9 taken along the lines VIII—VIII and constructed in accordance with the invention.
Figure 9:
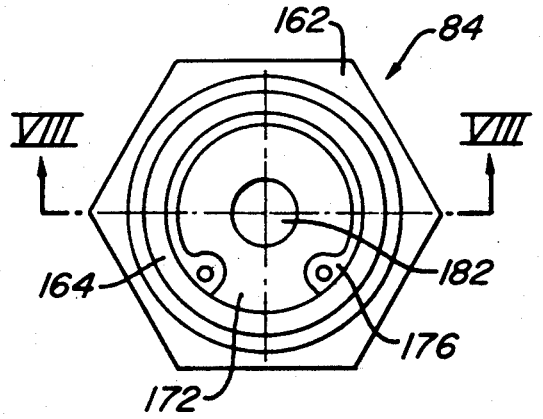
FIG. 9 is a bottom plan view of the restoration valve constructed in accordance with the invention.

The restoration valve 84, shown in FIGS. 8 and 9, consists of a body 160 having a hexagonal head 162 and a threaded lower portion 164 for coupling to the port 85. A cavity 166 is formed in the body 160 and is joined by an axial passage 168 extending through the head 162 thereby defining a ledge 169.

A valve member 170 is disposed within the cavity 166 and has a piston 172 located on the lower portion of the valve member 170. An outwardly biased, coiled valve spring 174 encircles the valve member 170 and is disposed between the piston 172 and the ledge 169, thereby forcing the piston 172 against a retaining ring 176 which retains the valve member 170 within the cavity 166. A cylindrical body 178 extends from the valve member 170, defining an annular shoulder 180 on the valve member 170. The axial passage 168 closely receives the cylindrical body 178 so that as the valve member 170 moves within the cavity 166, the cylindrical body 178 telescopically slides within the axial passage 168.

Located in the lower portion of the valve member 170 is an axial port 182. Radially extending ports 184 in the valve member 170 join the axial port 182 to the cavity 166. The cylindrical body 178 also has an axial port 186 which is in fluid communication with the cavity 166 by means of port 186.

When the cushioning device 10 is at rest, the restoration valve 84 is maintained in the open position with the valve spring 174 forcing the piston 172 against the retaining ring 176. Fluid flows through the valve 84 by entering through the axial port 182 in the valve member 170. The fluid flows into the cavity 166 by means of the radial ports 184, into the axial port 188 of the cylinder body 178 by means of the port 186 and out the axial passage 168.

As the fluid pressure applied against the piston 172 increases to overcome the force of the valve spring 174, the valve member 170 is raised. This causes the cylindrical body 178 to slide axially into the passage 168 so that the port 186 is effectively closed so that fluid does not flow through the valve 84. Further movement of the cylindrical body 178 in the axial passage 168 is prevented as the annular shoulder 180 engages the ledge 169.

The operation of the cushioning device 10 is as follows. When the cushioning device 10 is at rest, the piston 34 is in the full draft or extended position near the cylinder head 46. When the coupler 64 of the railcar is subjected to high buff forces, the force exerted against the body 20 from the coupler 64 of the cushioning device 10 causes the housing 24 and cylinder 28 to move in the buff direction towards the housing support structure 18. The piston 34 is thereby forced through the cylinder 28 compressing the oil and gas mixture within the area 76 of the cylinder 28. When the oil and gas mixture within the area 76 reaches a high enough pressure, the pressure differential between the fluid reservoir 32 and area 76 will cause the pressure relief valves 80 to open. This allows the oil and nitrogen gas mixture to flow from the area 76 in cylinder 28 into the fluid recovery reservoir 32.

Because the pressure relief valves 80 on the cylinder wall 30 open only in response to a given pressure differential before opening, the piston 34 tends to remain stationary within the cylinder 28 until the pressure within the area 76 of the cylinder 28 overcomes the specified force required to open the pressure relief valves 80. This causes the body 20 and coupler 64 to remain stationary relative to the sill 12 of the railcar and minimizes slack or play in the cushioning device 10.

When the pressure relief valves 80 open, the escaping oil and gas exit the cylinder 28 and flow into the reservoir 32. As the piston 34 moves to the buff end of the cylinder 28, the volume of area 78 is increased thus reducing the pressure within the area 78. The combined effect of the oil and gas being forced into the reservoir 32 and the reduced pressure within area 78 cause the oil and gas to flow from the reservoir 32, through the buff flow passage (not shown), into the buff flow chamber 94 formed in the cylinder heads 46, 52, and into the slider valve sleeve chamber 96.

The slider valve 90 is forced against the slider valve retainer lip 98 by the suction from the reduced pressure in area 78 and the fluid forced into the sleeve chamber 96. Because the slider valve retainer lip 98 is discontinuous, the oil and gas continue to flow past the slider valve 90 and retainer lip 98 and into the area 78 behind the piston 34. The increasing volume of the area 78 behind the piston 34 is thus filled with the oil and gas mixture as the piston 34 moves toward the bulkhead 40.

A small amount of oil and gas also flow into area 78 through the two floating ball valves 82 and restoration valve 84 as the piston 34 moves to the buff end of the cylinder 28.

When a large draft force is applied against the coupler 64, the piston 34 is urged toward the cylinder head 46. This causes the slider valve 90 to move and seat against the sealing surface 102 formed in the cylinder head 46. The floating ball valves 82 in ports 83 and 88, and the restoration valve 84 also close. Oil and gas is thus prevented from escaping from the area 78 by flowing back through the sleeve chamber 96, floating ball valves 82 and restoration valve 84. As the pressure within area 78 increases, the pressure relief valves 80 located to the rear of the piston 34 open to allow oil and gas to flow into the reservoir 32 and into area 76 of cylinder 28 through check valve 86 located at the buff end of the cylinder 28.

If the draft force is too low, however, the piston 34 will tend to remain stationary until the pressure within the area 78 behind the piston 34 overcomes the force necessary to open the pressure relief valves 80.

When the force applied to the coupler 64 is removed from the cushioning device 10, the restoring force applied to the body 20 of the cushioning device 10 causes the piston 34 and piston rod 36 to move to the draft end of the cushioning device 10. The restoration valve 84 located in the cylinder wall 30 allows oil and gas at the lower pressure to escape from the area 78 and into the reservoir 32 as the piston 34 is restored to the draft position. Fluid reenters the area 76 in front of piston 34 from the reservoir 32 through the check valve 86 located at the buff end of the cylinder 28.

If a substantial extension or draft force is applied to the cushioning unit 10 before the piston 34 is restored to the draft position, the restoration valve 84 will close to prevent fluid from flowing through the port 85 and thereby increasing the impedance of the cushioning unit 10. The fluid pressure required to close the restoration valve 84 is well below that required to open the pressure relief valves 80.

When the cushioning device 10 is at rest, gas which collects in the top of the cylinder 28 is exhausted into the reservoir 32 through the restoration valve 84 and the floating ball valve 82 mounted in port 83. Oil displaced by the gas entering the reservoir 32 flows into the cylinder 28 through the floating ball valve 82 in port 88. This allows the pressure to equalize within the cushioning unit 10.

This invention has several advantages over the prior art. All the ports formed in the cylinder of the cushioning device are provided with valves to limit the flow of fluid between the cylinder and fluid recovery reservoir. The pressure relief valves are normally closed, opening only in response to a given fluid pressure differential and thus prevent the cushioning device from responding to low forces applied to the coupler. This minimizes the slack between the railway cars which is experienced when the cushioning device responds to these low buff and draft forces. The bleed valve in the top of the cylinder also aids in minimizing slack between the railway cars by reducing the amount of gas, which is highly compressible, within the cylinder.

While the invention has been shown in only one of its forms, it should be apparent to those skilled in the art that it is not so limited, but is susceptible to various changes without departing from the scope of the invention.

I claim:

1. In a cushioning device for absorbing buff and draft movement between railway cars having a fluid recovery reservoir, a cylinder containing a mixed gas and liquid fluid, the cylinder having a cylinder wall and being located within the reservoir, a bulkhead at one end of the cylinder and a cylinder head at the other end of the cylinder having a hole therethrough, a piston located within the cylinder which moves from an extended position to a contracted position, the piston having a rod extending through the hole for cushioning the buff and draft movement, coupling means on the rod and the bulkhead opposite the rod for connecting the cushioning device between two railway cars, and a plurality of egress ports located within a portion of the cylinder wall between the piston and the bulkhead when the piston is in the extended position, the egress ports being located at various distances from the bulkhead, the improvement comprising:

a plurality of spring-biased pressure relief valves, each coupled within one of the egress ports, each of the pressure relief valves being openable to allow fluid to flow only in one direction through said egress ports from the cylinder to the reservoir in response to a selected fluid pressure differential within the cylinder relative to the reservoir due to buff and impact movements;

a restoration port located in the cylinder wall adjacent to the cylinder head for allowing flow of the fluid to the reservoir as gas pressure in the cylinder moves the piston toward the cylinder head when free of buff and draft movement; and a restoration valve coupled to the restoration port for preventing flow through the restoration port if draft movement occurs during restoration, causing fluid to flow out any of the pressure relief valves located between the cylinder head and the piston.

2. The cushioning device of claim 1, further comprising:

a liquid return port located below a liquid level in the cylinder for allowing liquid to flow from the cylinder to the reservoir while the cushioning device is free of buff and draft movement; and a liquid return valve coupled to the liquid return port for preventing flow through the liquid return port in the event of a pressure differential in the cylinder created by draft movement above a selected level.

3. In a cushioning device for absorbing impact between railway cars having a fluid recovery reservoir, a cylinder containing a mixed gas and liquid, the cylinder having a cylinder wall and being located within the reservoir, a bulkhead at one end of the cylinder and a cylinder head at the other end of the cylinder having a hole therethrough, a piston located within the cylinder which moves from an extended position to a contracted position, the piston having a rod extending through the hole for cushioning the impact, coupling means on the rod and the bulkhead opposite the rod for connecting the cushioning device between two railway cars, and a plurality of egress ports located within a portion of the cylinder wall between the piston and the bulkhead when the piston is in the extended position, the egress ports being located at various distances from the bulkhead, the improvement comprising:

plurality of spring-biased valves, each coupled within one of the egress ports, the valves being openable to allow fluid to flow only in one direction through said egress ports from the cylinder to the reservoir in response to a selected fluid pressure differential within the cylinder; and wherein each of the valves comprises:

a body having a longitudinal axis which couples to the egress port;

a valve piston slidingly mounted within the body and having an axial passage;

a valve seat joined to the body, the valve seat being a frusto-conical recess;

a frusto-conical shaped head joined to the valve piston which sealingly engages the valve seat for preventing fluid flow through the valve;

a plurality of valve ports extending through the head and joining the axial passage, the valve ports allowing fluid to pass through the axial passage of the valve when the head is unseated from the valve seat; and resilient biasing means for urging the head of the valve piston into engagement with the valve seat.

4. The cushioning device of claim 3, wherein:

each of the valve ports has an axis which is at an acute angle in relation to the longitudinal axis of the body.

5. The cushioning device of claim 3, wherein:

the resilient biasing means consists of a coil spring encircling the valve piston.

6. A cushioning device for absorbing buff and draft movement between railway cars, comprising in combination:

a fluid recovery reservoir;

a cylinder containing a mixed gas and liquid fluid, the cylinder having a cylinder wall and being located within the reservoir;

a bulkhead at one end of the cylinder and a cylinder head at the other end of the cylinder having a hole therethrough;

a piston located within the cylinder which moves from an extended position to a contracted position, the piston having a rod extending through the hole for cushioning the impact;

coupling means on the rod and the bulkhead opposite the rod for connecting the cushioning device between two railway cars;

a plurality of egress ports located within a portion of the cylinder wall between the piston and the bulkhead when the piston is in the extended position, the egress ports being located at various distances from the bulkhead;

a plurality of pressure relief valve means, each coupled to one of the egress ports for allowing fluid to flow only in one direction through said egress ports from the cylinder to the reservoir in response to a selected fluid pressure differential between the cylinder and the reservoir due to buff and draft movement;

a restoration port located in the cylinder wall adjacent to the cylinder head for allowing flow of the fluid to the reservoir as gas pressure in the cylinder moves the piston toward the cylinder head when free of buff and draft movement; and a restoration valve coupled to the restoration port for preventing flow through the restoration port if draft movement occurs of a magnitude above a selected level during restoration, causing fluid to flow through any of the pressure relief valves located between the piston and the cylinder head.

7. The cushioning device of claim 6, further comprising:

a liquid return port located below a liquid level in the cylinder for allowing liquid to flow from the cylinder to the reservoir while the cushioning device is at rest; and a liquid return valve coupled to the liquid return port for preventing flow through the liquid return port in the event of a significant draft movement.

8. The cushioning device of claim 6, further comprising:

gas bleed valve means for allowing gas to flow from the cylinder to the reservoir while the cushioning device is at rest, the gas bleed valve means closing in response to a minimum pressure differential between the cylinder and reservoir created by a draft movement; and liquid return means located below a liquid level in the cylinder for allowing liquid to flow from the cylinder to the reservoir while the cushioning device is at rest and for preventing flow through the liquid return means in response to a minimum pressure differential created by draft movement.

9. A cushioning device for absorbing impact between railway cars, comprising in combination:

a fluid recovery reservoir;

a cylinder containing a mixed gas and liquid, the cylinder having a cylinder wall and being located within the reservoir;

a bulkhead at one end of the cylinder and a cylinder head at the other end of the cylinder having a hole therethrough;

a piston located within the cylinder which moves from an extended position to a contracted position, the piston having a rod extending through the hole for cushioning the impact;

coupling means on the rod and the bulkhead opposite the rod for connecting the cushioning device between two railway cars;

a plurality of egress ports located within a portion of the cylinder wall between the piston and the bulkhead when the piston is in the extended position, the egress ports being located at various distances from the bulkhead; and a plurality of valve means, each coupled to at least one of the egress ports for allowing fluid to flow only in one direction through said egress ports from the cylinder to the reservoir in response to a selected fluid pressure differential within the cylinder; and wherein each of the valve means comprises:

a body having a longitudinal axis which couples to the egress port;

a valve piston slidingly mounted within the body and having an axial passage;

a valve seat joined to the body, the valve seat being a frusto-conical recess;

a frusto-conical shaped head joined to the valve piston which sealingly engages the valve seat for preventing fluid flow through the valve means;

a plurality of valve ports extending through the head and joining the axial passage, the valve ports allowing fluid to pass through the axial passage of the valve when the head is unseated from the valve seat; and resilient biasing means for urging the head of the valve piston into engagement with the valve seat.

10. The cushioning device of claim 9, wherein:

each of the valve ports has an axis which is at an acute angle in relation to the longitudinal axis of the body.

11. The cushioning device of claim 9, wherein:

the resilient biasing means consists of a coil spring encircling the valve piston.

12. A valve in a cushioning device for absorbing impact between railway cars having a fluid recovery reservoir, a cylinder containing a mixed gas and liquid, the cylinder having a cylinder wall and being located within the reservoir, a bulkhead at one end of the cylinder and a cylinder head at the other end of the cylinder having a hole therethrough, a piston located within the cylinder which moves from an extended position to a contracted position, the piston having a rod extending through the hole for cushioning the impact, coupling means on the rod and the bulkhead opposite the rod for connecting the cushioning device between two railway cars, and a plurality of egress ports located within a portion of the cylinder wall between the piston and the bulkhead when the piston is in the extended position, the egress ports being located at various distances from the bulkhead, the valve coupled within at least some of the egress ports and being openable to allow fluid to flow only in one direction through said egress ports from the cylinder to the reservoir in response to a selected fluid pressure differential within the cylinder, the valve comprising:

a body having a longitudinal axis which couples to the egress port;

a valve piston slidingly mounted within the body and having an axial passage;

a valve seat joined to the body, the valve seat being a frusto-conical recess;

a frusto-conical shaped head joined to the valve piston which sealingly engages the valve seat for preventing fluid flow through the valve;

a plurality of valve ports extending through the head and joining the axial passage, the valve ports allowing fluid to pass through the axial passage of the valve when the head is unseated from the valve seat; and resilient biasing means for urging the head of the valve piston into engagement with the valve seat.

13. The valve of claim 12, wherein:

each of the valve ports has an axis which is at an acute angle in relation to the longitudinal axis of the body.

14. The valve of claim 12, wherein:

the resilient biasing means consists of a coil spring encircling the valve piston.

15. In a cushioning device for absorbing impact between railway cars having a fluid recovery reservoir, a cylinder containing a mixed gas and liquid, the cylinder having a cylinder wall and being located within the reservoir, a bulkhead at one end of the cylinder and a cylinder head at the other end of the cylinder having a hole therethrough, a piston located within the cylinder which moves from an extended position to a contracted position, the piston having a rod extending through the hole for cushioning the impact, coupling means on the rod and the bulkhead opposite the rod for connecting the cushioning device between two railway cars, and a plurality of egress ports located within a portion of the cylinder wall between the piston and the bulkhead when the piston is in the extended position, the egress ports being located at various distances from the bulkhead, the improvement comprising:

a spring-biased valve coupled within at least some of the egress ports, the valve being openable to allow fluid to flow only in one direction through said egress ports from the cylinder to the reservoir in response to a selected fluid pressure differential within the cylinder; and valve means for allowing gas to flow from the cylinder to the reservoir, the valve means closing in response to an internal pressure within the cylinder created by draft movement of the piston within the cylinder.

16. The cushioning device of claim 15, wherein:

the valve means includes a floating ball valve.

17. The cushioning device of claim 15, further comprising:

a second valve means for allowing oil to flow from the reservoir to the cylinder as gas flows from the cylinder through the first valve means, the second valve means also closing in response to the internal pressure created by draft movement of the piston within the cylinder.

18. The cushioning device of claim 17, wherein:

the second valve means includes a floating ball valve.

19. In a cushioning device for absorbing buff and draft movement between railway cars having a fluid recovery reservoir, a cylinder containing a mixed gas and liquid fluid, the cylinder having a cylinder wall and being located within the reservoir, a bulkhead at one end of the cylinder and a cylinder head at the other end of the cylinder having a hole therethrough, a piston located within the cylinder which moves from an extended position to a contracted position, the piston having a rod extending through the hole for cushioning the buff and draft movement, coupling means on the rod and the bulkhead opposite the rod for connecting the cushioning device between two railway cars, and a plurality of egress ports located within a portion of the cylinder wall between the piston and the bulkhead when the piston is in the extended position, the egress ports being located at various distances from the bulkhead, the improvement comprising:

a plurality of spring-biased pressure relief valves, each coupled within one of the egress ports, each of the pressure relief valves being openable to allow fluid to flow only in one direction through said egress ports from the cylinder to the reservoir in response to a selected fluid pressure differential between the cylinder and the reservoir due to buff and draft movement; and restoration valve means for allowing fluid to escape from the cylinder to the reservoir as the piston is moved to the extended position by a restoring force due to gas pressure, the restoration valve means closing in response to a second preselected pressure created by draft movement of the piston within the cylinder, the second preselected pressure differential being lower than the first pressure differential.

20. The cushioning device of claim 19, wherein:

the restoration valve means includes a spring biased valve.

* * * * *